US011359451B2

(12) United States Patent
Monteiro, Jr.

(10) Patent No.: US 11,359,451 B2
(45) Date of Patent: Jun. 14, 2022

(54) COMPACT OVER PULL-PUSH STROKING TOOL

(71) Applicant: FMC Technologies, Inc., Houston, TX (US)

(72) Inventor: Josué Vasconcelos Monteiro, Jr., Macaé (BR)

(73) Assignee: FMC TECHNOLOGIES, INC., Houston, TX (US)

( * ) Notice: Subject to any disclaimer, the term of this patent is extended or adjusted under 35 U.S.C. 154(b) by 74 days.

(21) Appl. No.: 16/957,227

(22) PCT Filed: Dec. 27, 2017

(86) PCT No.: PCT/US2017/068502
§ 371 (c)(1),
(2) Date: Jun. 23, 2020

(87) PCT Pub. No.: WO2019/132877
PCT Pub. Date: Jul. 4, 2019

(65) Prior Publication Data
US 2020/0399971 A1 Dec. 24, 2020

(51) Int. Cl.

| | |
|---|---|
| ***E21B 31/12*** | (2006.01) |
| ***E21B 33/043*** | (2006.01) |
| ***E21B 34/04*** | (2006.01) |
| ***E21B 41/04*** | (2006.01) |

(Continued)

(52) U.S. Cl.
CPC ..... *E21B 31/12* (2013.01); *E21B 33/035* (2013.01); *E21B 33/043* (2013.01); *E21B 33/12* (2013.01); *E21B 34/04* (2013.01); *E21B 41/04* (2013.01)

(58) Field of Classification Search
CPC ..... E21B 31/12; E21B 33/12; E21B 33/035; E21B 33/043; E21B 41/04; E21B 34/04
See application file for complete search history.

(56) References Cited

U.S. PATENT DOCUMENTS 8,534,363 B1 * 9/2013 Tseytlin ..... E21B 43/0122 166/335
2012/0193104 A1 * 8/2012 Hoffman ..... E21B 33/035 166/348

(Continued)

FOREIGN PATENT DOCUMENTS

EP 3231985 A1 10/2017
WO 2011161625 A1 12/2011

OTHER PUBLICATIONS

International Search Report issued in International Application No. PCT/US2017/068502 dated Aug. 23, 2018 (3 pages).

(Continued)

*Primary Examiner* — Robert E Fuller
*Assistant Examiner* — Neel Girish Patel
(74) *Attorney, Agent, or Firm* — Osha Bergman Watanabe & Burton LLP

(57) ABSTRACT

An extendable wellbore tool may include a housing, a telescopic cylinder, and one or more hydraulic actuators. The telescopic cylinder may be disposed within the housing and may include two or more cylinders configured to extend and retract relative to each other. The one or more hydraulic actuators may be connected to the telescopic cylinder via a link arm, and may be configured to extend and retract the telescopic cylinder relative to the housing.

23 Claims, 8 Drawing Sheets

(51) Int. Cl.
*E21B 33/035* (2006.01)
*E21B 33/12* (2006.01)

(56) References Cited

U.S. PATENT DOCUMENTS

| | | | | |
|---|---|---|---|---|
| 2014/0158365 | A1* | 6/2014 | Favilli | E21B 33/035 166/368 |
| 2014/0182858 | A1* | 7/2014 | Fenton | E21B 33/035 166/344 |
| 2017/0044865 | A1* | 2/2017 | Sabins | E21B 33/13 |

OTHER PUBLICATIONS

Written Opinion issued in International Application No. PCT/US2017/068502 dated Aug. 23, 2018 (6 pages).

* cited by examiner

COMPACT OVER PULL-PUSH STROKING TOOL

BACKGROUND

Subsea horizontal Christmas trees or subsea vertical Christmas trees are assemblies of valves, spools, fittings, and other components that isolate and redirect (control) the flow of oil or gas from a wellbore. Horizontal and vertical Christmas trees may commonly be referred to as Christmas trees and may feature up to two crown plugs, installed in their tubing hangers or internal tree caps to seal the vertical production bore and redirect wellbore fluids to the horizontal bore during production, or temporary tubing hanger plugs, that needs to be set or retrieved when the Christmas Trees are in commissioning or decommissioning process.

The crown plugs may be installed via slickline or coil tubing tools deployed through a vertical riser bore conduit. During a workover or well operation, it may be necessary to have full bore access to parts of the Christmas tree or the well's production tubing which may otherwise be blocked by the crown plugs, or as aforementioned, during commissioning or decommissioning of vertical Christmas Trees. Therefore, it is necessary to pull and retrieve the plugs prior to wellbore access operations. In some instances, it may also be necessary to pull and retrieve internal tree caps prior to wellbore access operations.

Crown plugs, temporary plugs or internal tree caps may become corroded, catalyze debris or otherwise damaged while they are installed in a Christmas tree. The surface of the Christmas tree which contacts the crown plug or internal tree cap may become similarly damaged. The corrosion or other damage may increase the amount of force necessary to remove a crown plug temporary plugs or internal tree cap from a Christmas tree or to install a crown plug, temporary plugs or an internal tree cap in a Christmas tree.

In some instances, there may be limited space within wellbore intervention equipment for an actuator to pull or install crown plugs or internal tree caps. An actuator with a smaller profile may be easier to deploy or less expensive to transport to and install at a subsea location and to integrate with currently used subsea wellbore equipment.

Therefore, it may be desired to provide an actuator for pulling and installing crown plugs, internal tree caps, and other elements in subsea Christmas trees, such that the actuator has a small profile and is capable of providing significant force, both while pulling and pushing.

SUMMARY OF THE DISCLOSURE

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, this disclosure relates to an extendable wellbore tool which may include a housing, a telescopic cylinder, and one or more hydraulic actuators. The telescopic cylinder may be disposed within the housing and may include two or more cylinders configured to extend and retract relative to each other. The one or more hydraulic actuators may be connected to the telescopic cylinder via a link arm, and may be configured to extend and retract the telescopic cylinder relative to the housing.

In another aspect, this disclosure relates to a method which may include the following steps: extending an extendable wellbore tool, the extendable wellbore tool being attached to a Christmas tree, performing a wellbore operation, and retracting the extendable wellbore tool. The extendable wellbore tool may include a housing, a telescopic cylinder, and one or more hydraulic actuators. The telescopic cylinder may be disposed within the housing and may include two or more cylinders configured to extend and retract relative to each other. The one or more hydraulic actuators may be connected to the telescopic cylinder via a link arm, and may be configured to extend and retract the telescopic cylinder relative to the housing.

In another aspect, this disclosure relates to a system which may include a housing, a telescopic cylinder, an extension line and a retraction line, one or more hydraulic actuators, and a link arm. The telescopic cylinder may be disposed within the housing and may include two or more cylinders configured to extend and retract relative to each other. The extension line and the retraction line may be configured to control fluid flow to extend and retract the cylinders of the telescopic cylinder relative to each other. The one or more hydraulic actuators may be connected to the telescopic cylinder via a link al in, and may be configured to extend and retract the telescopic cylinder relative to the housing. The link arm may connect the one or more hydraulic actuators to the telescopic cylinder.

Other aspects and advantages will be apparent from the following description and the appended claims.

DETAILED DESCRIPTION

Figure 1:
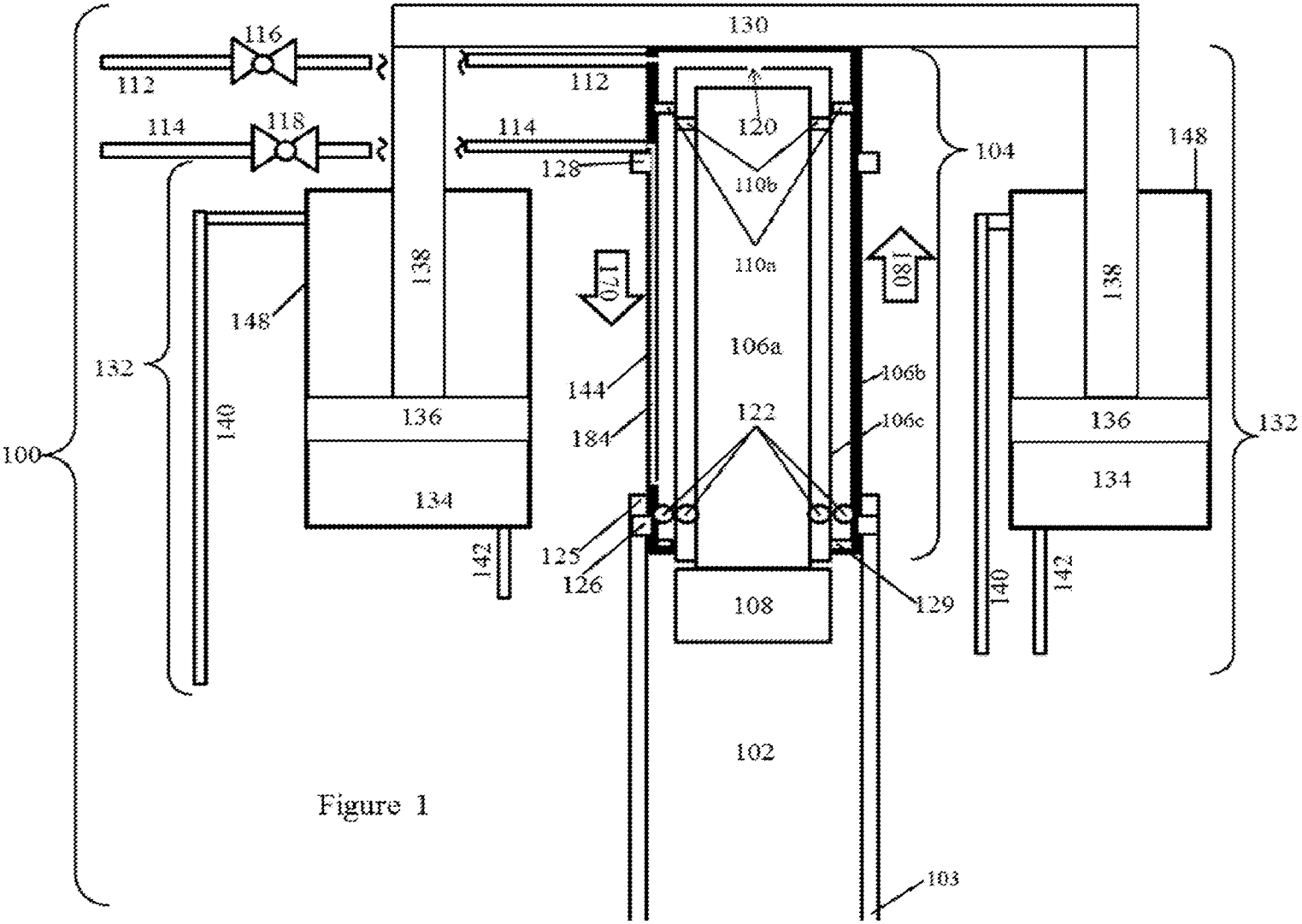
FIG. 1 is a cross-section view of an actuator in accordance with the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

As used herein, the term "coupled" or "coupled to" or "connected" or "connected to" may indicate establishing either a direct or indirect connection, and is not limited to either unless expressly referenced as such. Wherever possible, like or identical reference numerals are used in the figures to identify common or the same elements. The figures are not necessarily to scale and certain features and certain views of the figures may be shown exaggerated in scale for purposes of clarification.

In one aspect, embodiments disclosed herein relate to an actuator. The actuator may be configured to retrieve plugging elements from a subsea Christmas tree and to install plugging elements in a subsea Christmas tree.

The plugging elements to be installed or removed may be any type of plugging elements known in the art. The plugging elements may be referred to as crown plugs or internal tree caps in the following disclosure, but the actuators, systems, and methods disclosed herein may be used to install and retrieve any type of plugging element from a Christmas tree or wellhead without departure from the scope of the disclosure.

Figure 2:
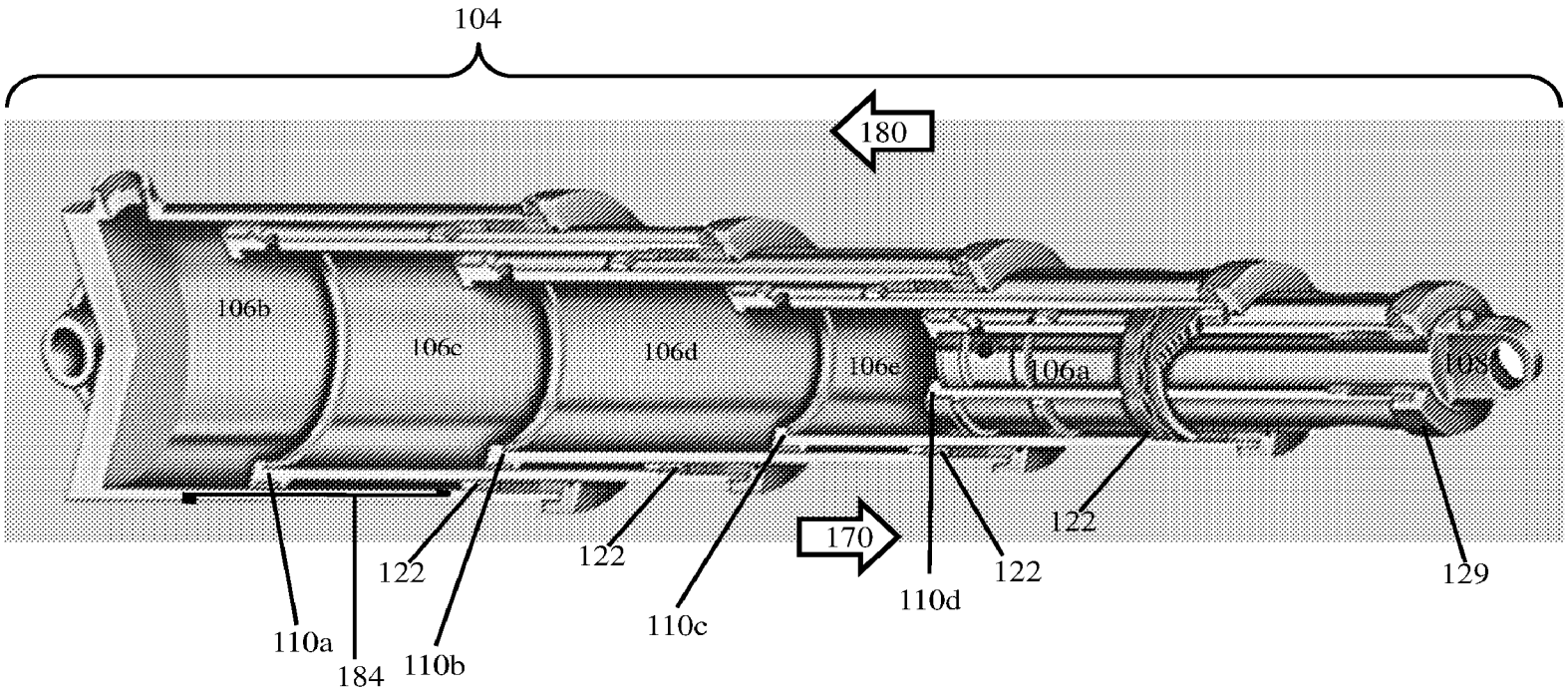
FIG. 2 is a cross-section view of a telescopic cylinder in accordance with the present disclosure.

FIG. 1 illustrates an extendable wellbore tool 100. The extendable wellbore tool 100 may include a telescopic cylinder 104 which may extend and retract through a housing 102. The telescopic cylinder 104 may be double-acting, such that both extension and retraction are actuated. Extension may refer to motion in the direction of arrow 170 and retraction may refer to motion in the direction of arrow 180. The telescopic cylinder 104 may be extended and retracted using two mechanisms. First, the telescopic cylinder 104 may include individually actuatable cylinders 106*a*, 106*c* which may be extended and retracted independently from each other. Second, the telescopic cylinder 104 may be attached to an actuating means which may be configured to extend and retract the entire telescopic cylinder 104, via movement of the outer cylinder 106*b*. FIG. 1 illustrates an embodiment of the telescopic cylinder having two individually actuatable cylinders 106*a*, 106*c* and FIG. 2 illustrates an embodiment having four individually actuatable cylinders 106*a*, 106*c*-106*e*.

The telescopic cylinder 104 may be disposed at least partially within the housing 102. An end (not shown) of the housing may be configured to be attached to a subsea Christmas tree (not shown) or other subsea wellhead component. The telescopic cylinder 104 may extend through the housing 102 to access the Christmas tree. In FIG. 1, the telescopic cylinder 104 is shown in a retracted configuration. FIG. 2 illustrates a telescopic cylinder 104 in an extended configuration, where like reference numbers refer to like elements.

The first mechanism by which the cylinders 106*a*, 106*c* are individually extended and retracted will now be discussed. The telescopic cylinder 104 may include an individually actuatable inner cylinder 106*a* within an outer cylinder 106*b*. In some embodiments, the telescopic cylinder 104 may also include one or more individually actuatable intermediate cylinders 106*c*. For example, the telescopic cylinder 104 shown in FIG. 1 includes one intermediate cylinder 106*c*. In some embodiments, the telescopic cylinder 104 may not include any intermediate cylinders 106*c*. The inner cylinder 106*a* may be solid or hollow. The intermediate cylinders 106*c* and the outer cylinder 106*b* may be hollow.

The cylinders 106*a*-106*c* of the telescopic cylinder 104 may be disposed within and operatively coupled to each other via annular barrier seals 110*a*-110*b*. The barrier seals 110*a*-110*b* may be disposed between the cylinders 106*a*-106*c*, such that a first barrier seal 110*a* is disposed between the outer cylinder 106*b* and the intermediate cylinder 106*c*, and a second barrier seal 110*b* is disposed between the intermediate cylinder 106*c* and the inner cylinder 106*a*. The barrier seals 110*a*-110*b* may maintain the cylinders 106*a*-106*c* at a desired circumferential distance from each other and allow the cylinders 106*a*-106*c* to slide relative to one another without damage to the barrier seals 110*a*-110*b*. Fluid flow may not be permitted across the barrier seals 110*a*-110*b*. The first barrier seal 110*a* may be fixedly attached to the intermediate cylinder 106*c* and sealably coupled to the outer cylinder 106*b* in a manner which allows the barrier seal 110*a* to translate relative to the outer cylinder 106*b*, while maintaining a seal. The second barrier seal 110*b* may be fixedly attached to the inner cylinder 106*a* and sealably coupled to the intermediate cylinder 106*c* in a manner which allows the barrier seal 110*b* to translate relative to the intermediate cylinder 106*c*, while maintaining a seal. The barrier seals 110*a*-110*b* may further function as hard-stops in conjunction with a shoulder or corresponding stop (not illustrated) on an adjacent cylinder, such that the barrier seals 110*a*-110*b* prevent the cylinders 106*a*-106*c* from extending beyond a certain configuration and from retracting beyond a certain configuration, so as to maintain hydraulic fluid flow capability. The configurations may be chosen such that hydraulic actuation may produce a desired extension and retraction of the cylinders 106*a*-106*c*, and to prevent damage to any components of the extendable wellbore tool 100.

Additionally, one or more supplemental seals 122 may be disposed between the cylinders 106*a*-106*c*. The supplemental seals 122 may maintain the cylinders 106*a*-106*c* at a desired circumferential distance from each other and allow the cylinders 106*a*-106*c* to translate relative to one another without damage to the supplemental seals 122. Fluid flow may or may not be permitted across the supplemental seals 122. The supplemental seals 122 may be annular.

The supplemental seals 122 and the barrier seals 110*a*-110*b* may be formed of a metal, an elastomer, some other material, or a combination of materials. The supplemental seals 122 and the barrier seals 110*a*-110*b* may or may not be seal assemblies.

The telescopic cylinder 104 may be hydraulically actuated via at least one extension line 112 and at least one retraction line 114. Flow of fluid through the extension line 112 and the retraction line 114 may be controlled by an extension valve 116 and a retraction valve 118, respectively. Flow of fluid through the extension line 112 and the retraction line 114 may cause the inner cylinder 106*a* to extend and retract relative to the intermediate cylinder 106*c* and may cause the intermediate cylinder 106*c* to extend and retract relative to the outer cylinder 106*b*. The flow of fluid through the extension line 112 and the retraction line 114 may not cause the outer cylinder 106*b* to extend or retract.

The extension line 112 and the retraction line 114 may each be connected to a fluid source or may be connected to a common fluid source 168, as shown in FIGS. 4*a*-4*e*. The fluid sources may be hot stabs provided by a remote operated vehicle. The extension line 112 and the retraction line 114 may be connected to the same fluid source or to different fluid sources. A fluid source may be a tank of fluid, a riser connected to a fluid source on a vessel, or an intake device configured to take in fluid, such as seawater, from the environment. The fluid source may be any source known in the art. The extension line 112 and the retraction line 114 may be flexible hoses.

Pressure from fluid flowed into the telescopic cylinder 104 may cause the cylinders 106*a*-106*c* to extend or retract differentially. The telescopic cylinder 104 may be designed such that different amounts of pressure are required to extend and retract the different cylinders 106*a*-106*c*. The amount of pressure required to extend the intermediate cylinder 106*b* relative to the outer cylinder 106*c* may be greater than the amount of pressure required to extend the inner cylinder 106*a* relative to the intermediate cylinder 106*c*. The amount of pressure required to retract the inner cylinder 106*a* relative to the intermediate cylinder 106*c* may be greater than the amount of pressure required to retract the intermediate cylinder 106*b* relative to the outer cylinder 106*b*. The telescopic cylinder 104 may include a mechanism (not shown) which prevents the cylinders 106*a*-106*c* from rotating relative to each other. In some embodiments, the cylinders 106*a*-106*c* may be able to rotate relative to each other and/or relative to the housing 102. For example, the cylinders 106*a*-106*c* may be able to rotate to align a wellbore element (not shown) connected to the interface tool 108 with another wellbore element or component (not shown).

The extension line 112 may be coupled to the outer cylinder 106*b* above the level of the barrier seal 110 disposed between the outer cylinder 106*b* and the intermediate cylinder 106*c*. Fluid may flow from the extension line 112 into the space between the outer cylinder 106*b* and the intermediate cylinder 106*c*, above the barrier seal 110. The intermediate cylinder 106*c* may include one or more upper passageways 120, which may or may not have valves (not shown) disposed therein. If the valve in the upper passageway 120 is open, fluid may flow from the space between the outer cylinder 106*b* and the intermediate cylinder 106*c* into the space between the intermediate cylinder 106*b* and the inner cylinder 106*a*, above the barrier seal 110*a*-110*b* disposed therebetween.

If the volume of fluid flowed into the telescopic cylinder 104 through the extension line 112 exceeds the volume of the spaces between the cylinders 106*a*-106*c* above the level of the barrier seals 110*a*-110*b* and the fluid reaches sufficient pressure, the fluid may push the inner cylinder 106*a* or the intermediate cylinder 106*c* downward, thereby extending the cylinders 106*a*, 106*c* of the telescopic cylinder 104. For example, if the valve in the upper passageway 120 is closed, the fluid may extend the intermediate cylinder 106*c* relative to the outer cylinder 106*b*, but may not extend the inner cylinder 106*a* relative to the intermediate cylinder 106*c*. For another example, if the barrier seals 110*a*-110*b* between the cylinders 106*a*-106*c* are designed such that the amount of pressure required to extend the inner cylinder 106*a* relative to the intermediate cylinder 106*c* is lower than the amount of pressure required to extend the intermediate cylinder 106*c* relative to the outer cylinder, then fluid flowed into the telescopic cylinder 104 through the extension line 112 may first cause the inner cylinder 106*a* to fully extend relative to the intermediate cylinder 106*c*, and may then cause the intermediate cylinder 106*c* to extend relative to the outer cylinder 106*b*.

The retraction line 114 may be coupled to the outer cylinder 106*b* above the level of an upper stop 128. A fluid passageway 184 may extend within the wall of the outer cylinder 106*b* to transport the fluid from the retraction line 114 to the space between the outer cylinder 106*b* and the intermediate cylinder 106*c*. This may allow the retraction line 114 to be coupled to the outer surface 144 near the top of the outer cylinder 106*b*, but to flow fluid into the interior of the outer cylinder 106*b* at a level below the barrier seal 110*a* between the outer cylinder 106*b* and the intermediate cylinder 106*c*.

Fluid may flow from the retraction line 114 into the space between the outer cylinder 106*b* and the intermediate cylinder 106*c*, below the barrier seal 110*a*. The intermediate cylinder 106*c* may include a retraction passageway (not shown) which may or may not have valves (not shown) disposed therein. If the valve in the retraction passageway is open, fluid may flow from the space between the outer cylinder 106*b* and the intermediate cylinder 106*c* into the space between the intermediate cylinder 106*b*, below the barrier seal 110*b* disposed therebetween. In some embodiments, a retraction passageway may extend along a length of the intermediate cylinder 106*c*, such that an inlet (not shown) is on an external face of the intermediate cylinder 106*c*, proximate the bottom of the cylinder 106*c*, and an outlet is on an internal face of the intermediate cylinder, proximate the top of the cylinder 106*c*. In other embodiments, retraction passageways may be arranged differently. One skilled in the art will recognize that retraction passageways may be designed based on the size and other specifications of the telescopic cylinder 104.

If the volume of fluid flowed into the telescopic cylinder 104 through the retraction line 114 exceeds the volume of the spaces between the cylinders 106*a*-106*c* below the level of the barrier seals 110*a*-110*b*, and the fluid reaches sufficient pressure, the fluid may push the inner cylinder 106*a* or the intermediate cylinder 106*c* upward, thereby retracting the cylinders 106*a*-106*c* of the telescopic cylinder 104 differentially. For example, if the valve in the retraction passageway is closed, the fluid may retract the intermediate cylinder 106*c* relative to the outer cylinder 106*b*, but may not retract the inner cylinder 106*a* relative to the intermediate cylinder 106*c*. For another example, if the barrier seals 110 between the cylinders 106*a*-106*c* are designed such that the amount of pressure required to retract the inner cylinder 106*a* relative to the intermediate cylinder 106*c* is greater than the amount of pressure required to move the intermediate cylinder 106*c* relative to the outer cylinder, then fluid flowed into the telescopic cylinder 104 through the retraction line 114 may first cause the intermediate cylinder 106*c* to fully retract relative to the outer cylinder 106*b* and may then cause the inner cylinder 106*a* to retract relative to the intermediate cylinder 106*c*.

The extendable wellbore tool 100 may include a mechanism to lock the telescopic cylinder 104 in a desired position. In some embodiments, locking may be achieved via hydraulic balancing, by simultaneously, pressuring the telescopic cylinder 104 via the extension line 112 and the retraction line 114, such that the cylinders 106*a*-106*c* are fully and evenly pressured on both sides. In some embodiments, other mechanisms may be used in addition to or instead of hydraulic balancing.

The second mechanism by which the entire telescopic cylinder 104 is extended and retracted by is external actuating means. The external actuating means may be configured to apply more force than the actuation of individual cylinders 106*a*-106*c* of the telescopic cylinder 104. The actuating means may extend or retract the telescopic cylinder 104 while the telescopic cylinder 104 is locked in any configuration or while the individual cylinders 106*a*-106*c* of the telescopic cylinder 104 are being differentially actuated.

An outer surface 144 of the outer cylinder 106*b* may be coupled to an inner surface of the housing 102 by a lower seal 126. The outer surface 144 of the outer cylinder 106*b* may comprise a lip 129. The housing 102 may comprise a shoulder 125. The lower seal 126 may be disposed between and sealably connected to the outer cylinder 106*b* and the housing 102, such that the lower seal 126 is below the shoulder 125 and above the lip 129. The lower seal 126 may allow the outer housing 106*b* to translate relative to the housing. The lip 129, the lower seal 126, and the shoulder 125 may provide a hard-stop, such that when the lip 129 contacts a lower side of the lower seal 126 and the shoulder 125 contacts an upper side of the lower seal 126, as shown in FIG. 1, the outer cylinder 106*b* is prevented from retracting any further. The outer surface 144 of the housing 102 may comprise an upper stop 128. The upper stop 128 and the shoulder 125 may provide a hard-stop, such that when the upper stop 128 contacts an upper surface of the shoulder 125, as shown in FIG. 2, the outer cylinder 106*b* is prevented from extending any further.

It is noted that the stop shoulder 128 may provide a positive stop for the outermost cylinder relative to housing 102. In some embodiments, stop shoulder 128 may not be used, noting that the range of motion of the outermost cylinder may be limited based on the range of motion of the piston 136 within actuators 132. Nonetheless, use of a stop shoulder 128 may be desired for installation purposes, to provide protection against damage to retraction line 114, and other factors recognizable to one skilled in the art.

The upper stop 128 and the lower seal 126 may be formed of a metal, an elastomer, some other material, or a combination of materials. The upper stop 128 and the lower seal 126 may or may not be shoulder assemblies.

The extension line 112 and the retraction line 114 may be coupled to the outer surface 144 of the outer cylinder 106*b* above the upper stop 128. This may prevent the extension line 112 and the retraction line 114 from being damaged as the outer cylinder 106*a* extends into the housing 102.

As shown in FIG. 1, the external actuation means may include one or more hydraulic actuators 132. A hydraulic actuator 132 may include a hydraulic cylinder 134 having a piston 136 disposed therein, a rod 138 extending from the piston 136, one or more over-extension lines 140, and one or more over-retraction lines 142. The embodiment of the extendable wellbore tool 100 shown in FIG. 1 includes two hydraulic actuators 132. An actuator may include any number of hydraulic actuators 132.

Figure 3:
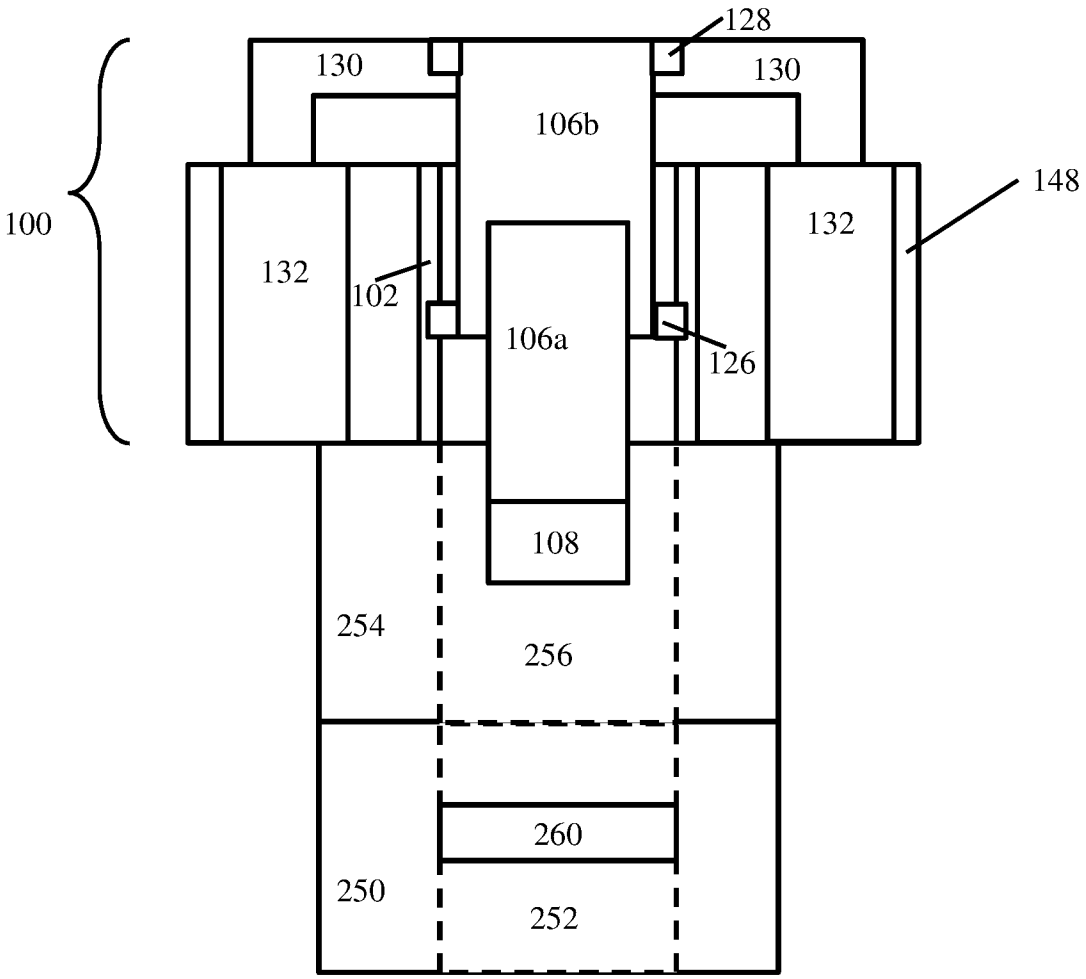
FIG. 3 is a cross-section view of a system in accordance with the present disclosure.

The hydraulic cylinders 134 may be fixedly attached to the housing 102. In some embodiments, such as shown in FIG. 3, the hydraulic actuators 132 may be attached to the housing 102 via an actuator housing 148 which surrounds the housing 102 and the hydraulic cylinders 134. In some embodiments, the hydraulic cylinder 134 may comprise an annular cylinder having an annular piston disposed therein which surrounds and is concentric with the housing 102 within the actuator housing 148. In some embodiments, as shown in FIGS. 4*a*-4*e*, the hydraulic actuators 132 may be attached to the housing 102 via anchors 158, bolts, tethers, or other mechanical means. In some embodiments, the hydraulic actuators 132 may be fixedly attached to a wellhead element which is in turn fixedly attached to the housing 102. Rigid attachment or anchoring of the hydraulic actuators 132 may allow the movement of the pistons 148 to transfer force to the outer cylinder 106*b* via the arm 130.

The rod 138 of the hydraulic actuator 132 may be coupled to a link arm 130, which may in turn be attached to the outer cylinder 106*b* of the hydraulic actuator 104. In this way, movement of the piston 136 of the hydraulic actuator 132 may be transferred to the telescopic cylinder 104. Downward movement of the piston 136 may extend the telescopic cylinder 104 through the housing 102. Upward movement of the piston 136 may retract the telescopic cylinder 104 through the housing 102. If the extendable wellbore tool 100 includes more than one hydraulic actuator 132, one or more hydraulic actuators 132 may be attached to a single link arm 130.

The hydraulic actuators 132 may be hydraulically actuated via at least one over-extension line 140 and at least one over-retraction line 142. Flow of fluid through the over-extension line 140 and the over-retraction line 142 may be controlled by valves (not shown). Flow of fluid through the over-extension line 140 and the over-retraction line 142 may cause the piston 136 to move downwards and upwards within the hydraulic cylinder 134, respectively.

The over-extension line 140 and the over-retraction line 142 may each be connected to a fluid source (not shown). In some embodiments, the fluid source may be a hot stab provided by a remote operated vehicle. The over-extension line 140 and the over-retraction line 142 may be connected to the same fluid source or to different fluid sources. A fluid source may be a tank of fluid, a riser connected to a fluid source on a vessel, or an intake device configured to take in fluid, such as seawater, from the environment. The fluid source may be any source known in the art. The over-extension line 140 and the over-retraction line 142 may be flexible hoses.

Full pressurization above the piston 136 may cause the upper stop 128 of the outer cylinder 106*b* to engage with the shoulder 125 of the housing 102. This configuration may represent full extension. Full pressurization below the piston 136 may cause the lower seal 126 of the outer cylinder 106*b* to engage with the shoulder 146 of the housing 102. This configuration may represent full retraction.

The piston 136 may act as a seal within the hydraulic cylinder 134, such that fluid below the piston 136 may not pass into the space above the piston 136, and/or vice versa. The over-extension line 140 may be connected to the hydraulic cylinder 134 above the level of the piston 136. If the volume of fluid flowed into the hydraulic cylinder 134 via the over-extension line 140 is greater than the volume of the space above the piston 136, and the fluid reaches sufficient pressure, the fluid may push the piston 136 downwards. The downwards movement may be transferred to the telescopic cylinder 104, such that the telescopic cylinder 104 extends through the housing 102. The over-retraction line 142 may be connected to the hydraulic cylinder 134 below the level of the piston 136. If the volume of fluid flowed into the hydraulic cylinder 134 via the over-retraction line 142 is greater than the volume of the space below the piston 136, and the fluid reaches sufficient pressure, the fluid may push the piston upwards. The upwards movement may be transferred to the telescopic cylinder 104 via rods 138 and link an is 130, such that the telescopic cylinder 104 retracts through the housing 102.

The hydraulic actuator 132 may include a mechanism to lock the piston 136 in a desired position. In some embodiments, locking may be achieved via hydraulic balancing, by simultaneously, pressuring the hydraulic cylinder 134 via the over-extension line 140 and the over-retraction line 142, such that the hydraulic cylinder 134 are fully and evenly pressured on both sides of the piston 136. In some embodiments, other mechanisms may be used in addition to or instead of hydraulic balancing.

If an extendable wellbore tool 100 includes more than one hydraulic actuator 132, the hydraulic actuators 132 may communicate with each other such that the position of each hydraulic actuator 132 is the same. In this way, the hydraulic actuators 132 may apply the same force to the telescopic cylinder 104 and may avoid applying asymmetrical force to the link arm 130, as such asymmetrical force may damage the link arm 130 or telescopic cylinder 104.

In some embodiments, the external actuation means may be any actuation means known in the art. The external actuation means may be configured to extend and retract the entire telescopic cylinder 104, and to provide more force than the differential actuation of the cylinders 106*a*-106*c*. The external actuation means may have a short profile. In some embodiments, the external actuation means may be mechanical.

The two extension/retraction mechanisms may be used to move interface tool 108 into a bore of a subsea Christmas tree (not shown) and to install or remove a plugging element (not shown) using the interface tool 108.

The interface tool 108 may be disposed on an end of the inner cylinder 106*a*. The inner cylinder 106*a* may be configured to extend through the housing 102 to reach the bore of the attached Christmas tree. The extendable wellbore tool 100 may be configured such that different interface tools 108 may be installed on the inner cylinder 106*a*.

The interface tool 108 may be capable of grasping, releasing, and/or manipulating the plugging element. The interface tool 108 may grasp, release, and/or manipulate the plugging element through any means known in the art. In some embodiments, the interface tool 108 may function via a reversible mechanism, which may grasp and release the plugging element without damage to either the plugging element or the interface tool 108. In some embodiments, the interface tool 108 may be remotely controlled, such that grasping and releasing may be controlled from a vessel. In some embodiments, the interface tool 108 may be mechanically controlled, such that manipulation of the interface tool 108 may control grasping and releasing.

In some embodiments, the interface tool 108 may be configured to grasp, release, and/or manipulate a tool for use in a wellbore operation. For example, the interface tool 108 may grasp, release, and/or manipulate a brush tool which may be used to clean a plug profile within a subsea Christmas tree. The interface tool 108 may be configured to grasp, release and/or manipulate both plugging elements and tools.

The extendable wellbore tool 100 may include sensors which may measure position, pressure, flow rate, or any other relevant property. Sensors may be positioned on any part of the extendable wellbore tool 100. For example, position sensors may sense positions of the cylinders 106*a*-106*c* of the telescopic cylinder 104, the position of the piston 136 of the hydraulic actuator 132, or the position of the outer cylinder 106*c* within the housing 102. Pressure sensors may measure pressure within the telescopic cylinder 104 or the hydraulic cylinder 134. Flow rate sensors may measure the flow of fluid through the extension line 112, the retraction line 114, the over-extension line 140, or the over-retraction line 142. Information from the sensors may be displayed to a human operator or may be used to automatically control functions of the actuator.

The extendable wellbore tool 100 may, in some embodiments, have a height of between one and ten meters, between two and five meters, or of about three meters. The extendable wellbore tool 100 may have any diameter. In some embodiments, at least the innermost cylinder 106*a* of telescopic cylinder 104 may have a diameter less than the inner diameter of a subsea Christmas tree to which the extendable wellbore tool will be attached and the cylinder(s) extended into. The dimensions of the extendable wellbore tool 100 and the components of the actuator may be determined by the subsea Christmas tree and the plugging element with which the extendable wellbore tool 100 is desired to be used. The extendable wellbore tool 100 may have a shorter height than conventional actuators which are configured to apply the same amount of force and to extend the same distance. For example, a standard linear actuator which extends ten meters will necessarily have a height of at least ten meters. The extendable wellbore tool 100 disclosed herein may, for example, be able to reach about twenty meters, while having a height of about five meters. The hydraulic actuators 132 may provide greater force than standard linear actuators. Therefore, the present actuator may be able to provide more force than traditional actuators, while taking up less space than traditional actuators.

The actuator described above may be used as part of a system, as shown in FIG. 3. The system may include an actuator and a subsea Christmas tree. Optionally, the system may also include a plugging element and/or other wellhead equipment.

The housing 102 of the extendable wellbore tool 100 may be fixedly connected to the Christmas tree 250, such that the housing 102 and the telescopic cylinder 104 are concentric with a bore 252 of the Christmas tree 250. The housing 102 may be connected to the Christmas tree 250 through any means known in the art.

A plugging element 260 may be installed in the bore 252 of the Christmas tree 250, as shown in FIG. 3, or on the interface tool 108 of the extendable wellbore tool 100. A plugging element 260 installed on the interface tool 108 may be configured to fit within the bore of the Christmas tree 252. In some embodiments, the system may include more than one plugging element 260.

The system may also include other wellhead equipment 254. For example, the system may include a well control package or adapter configured to hold multiple plugging elements and/or tools. In such an embodiment, the equipment 254 may be connected between the extendable wellbore tool 100 and the Christmas tree 250, such that an end of the adapter 100 is fixedly attached to the equipment 254 and the equipment 254 is fixedly attached to the Christmas tree 250. A bore 256 of the equipment 254 may be concentric with the bore 252 of the Christmas tree 250, the housing 102, and the telescopic cylinder 104.

The actuator and/or the system described above may be used to remove a plugging element from a subsea Christmas tree and/or install a plugging element in a subsea Christmas tree.

Figure 4A:
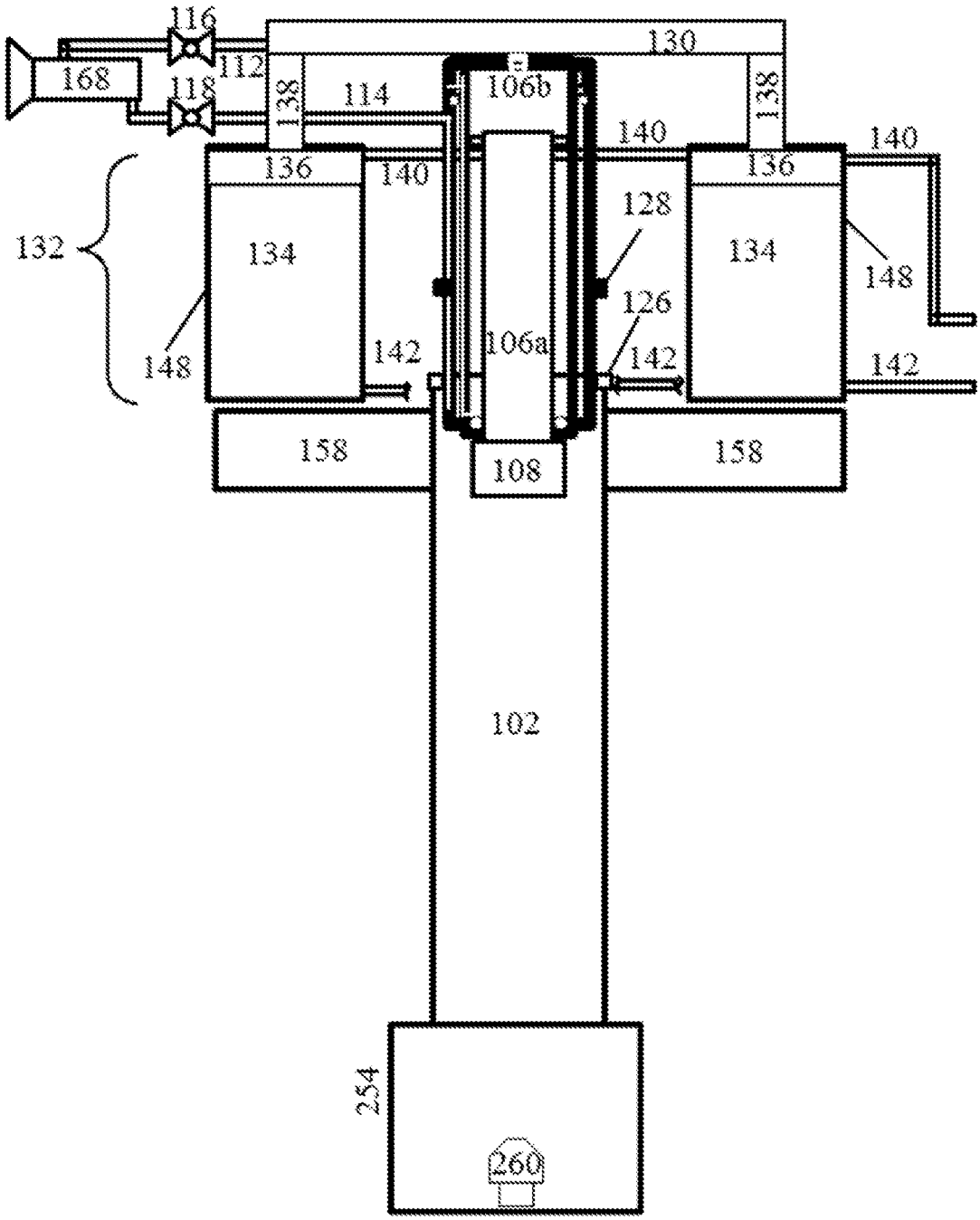
FIGS. 4*a*-4*e* are cross-section views of a system in accordance with the present disclosure.

A method of removing a plugging element from a subsea Christmas tree will first be described with reference to FIGS. 3 and 4*a*-4*e*. As shown in FIG. 4*a*, the housing 102 of the extendable wellbore tool 100 may be fixedly attached to a subsea Christmas tree 250 or to a piece of wellhead equipment 254 fixedly attached to the Christmas tree 250. The cylinders 106*a*-106*c* of the telescopic cylinder 104 may be differentially extended to position the telescopic cylinder 104 in a desired configuration. The desired configuration may be determined by the location of a plugging element 260 within a bore 252 of the Christmas tree 250.

Figure 4B:
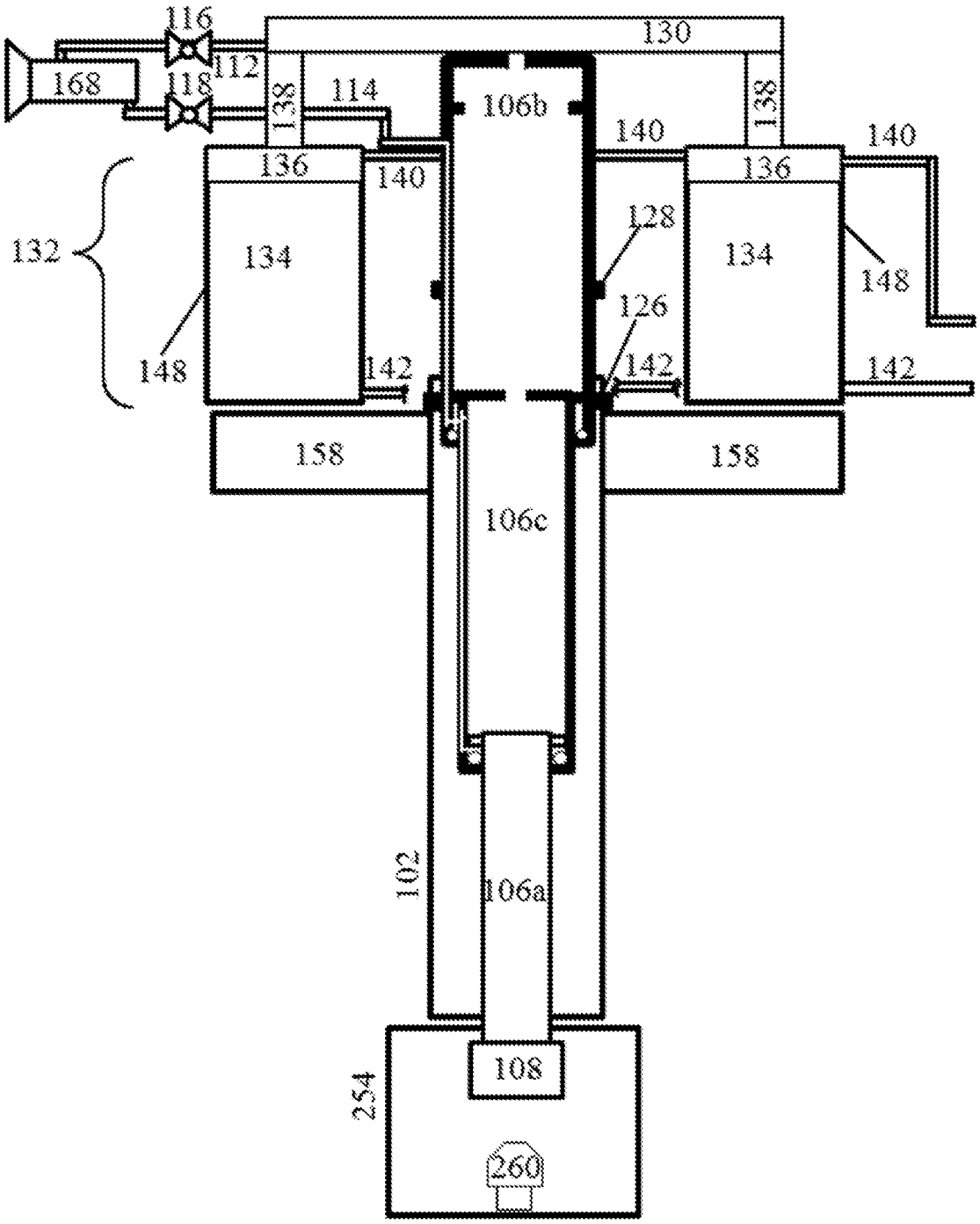

The telescopic cylinder 104 may be differentially actuated, as shown in FIG. 4*b*, through the following method. The extension valve 116 may be opened, allowing fluid from the extension line 112 to flow into the telescopic cylinder 104. The volume of fluid flowed into the hydraulic cylinder 104 may be greater than the volume of the space between the cylinders 106*a*-106*c* above the barrier seals and the pressure produced by the fluid may be sufficient to extend the inner cylinder 106*a* and/or the intermediate cylinder 106*c*. The fluid may push the inner cylinder 106*a* downward with respect to the intermediate cylinder 106*c*. The fluid may push the intermediate cylinder 106*c* downward with respect to the outer cylinder 106*a*. The distance which the inner cylinder 106*a* and the intermediate cylinder 106*c* are extended may be controlled. While the telescopic cylinder 104 is differentially extended, the hydraulic actuators 132 may be locked in position. In some embodiments, the hydraulic actuators 132 may be locked in a partially or fully extended position.

Figure 4C:
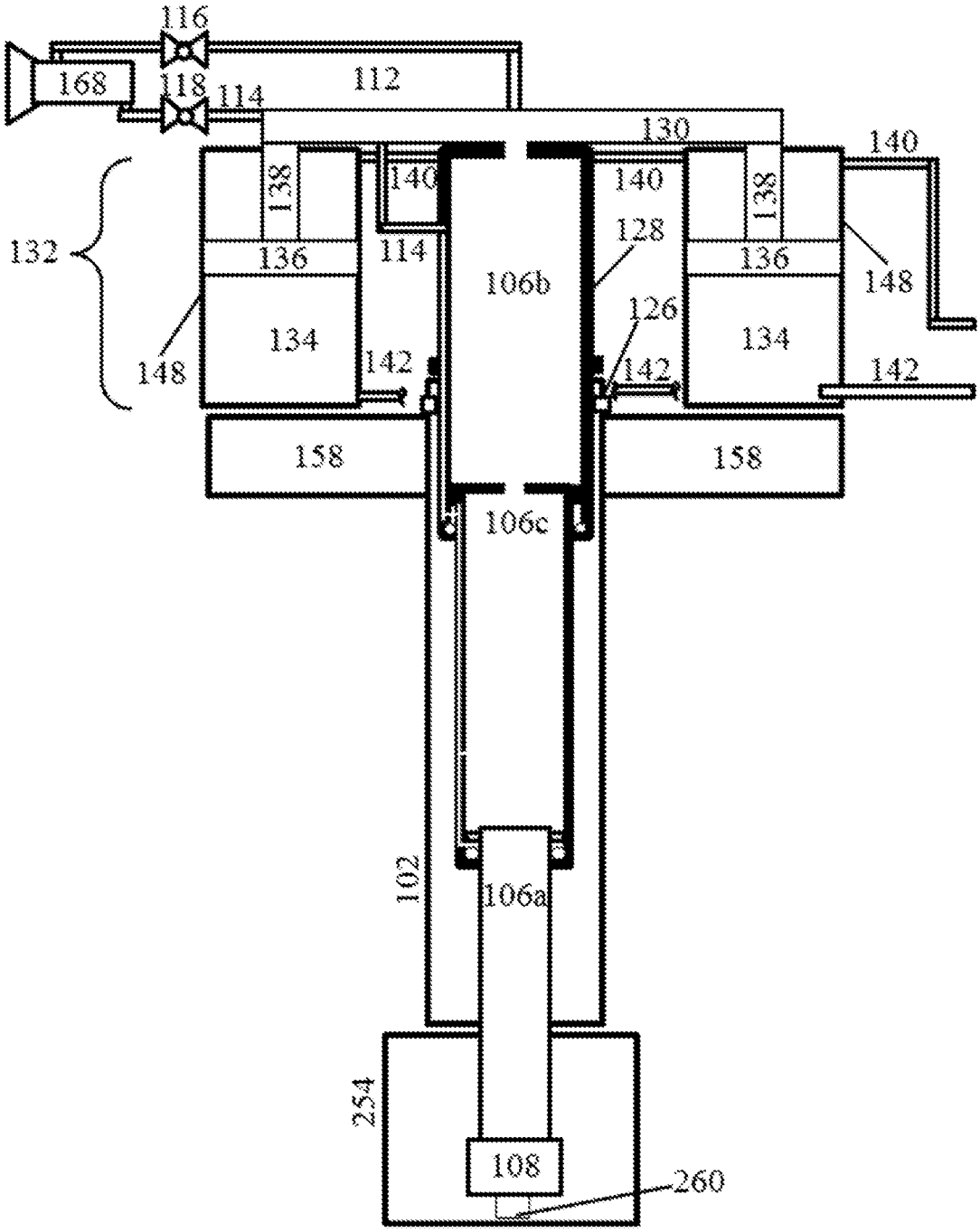

In some embodiments, as shown in FIG. 4*c*, a hydraulic actuator 132 may extend the telescopic cylinder 104 through the following method. Fluid may be flowed from the over-extension line 140 into the hydraulic cylinder 134. The volume of fluid flowed into the hydraulic cylinder 134 may be greater than the volume of the space above the piston 136 in the hydraulic cylinder 134, and the pressure of the fluid may be sufficient to actuate the piston 136. The fluid may push the piston 136 downwards. The force of this movement may be transferred to the telescopic cylinder 104 via the rod 138 and the link arm 130, such that the telescopic cylinder 104 is extended. While the telescopic cylinder 104 is extended by the hydraulic actuators 132, the cylinders 106*a*-106*c* may be locked in position such that the cylinders 106*a*-106*c* may not differentially extend or retract. In some embodiments, the hydraulic actuator 132 may not be used to extend the telescopic cylinder 104.

The telescopic cylinder 104 may be extended to a position in which the interface tool 108 contacts the plugging element 260, as shown in FIG. 4*c*. The interface tool 108 may be latched to the plugging element 260. The latching may be performed by any means known in the art.

After the interface tool 108 has been latched to the plugging element 260, the telescopic cylinder 104 may be retracted by the external actuation means, which may include one or more hydraulic actuators 132. The hydraulic actuators 132 may provide sufficient force to disengage the plugging element 260 from the Christmas tree 250.

Figure 4D:
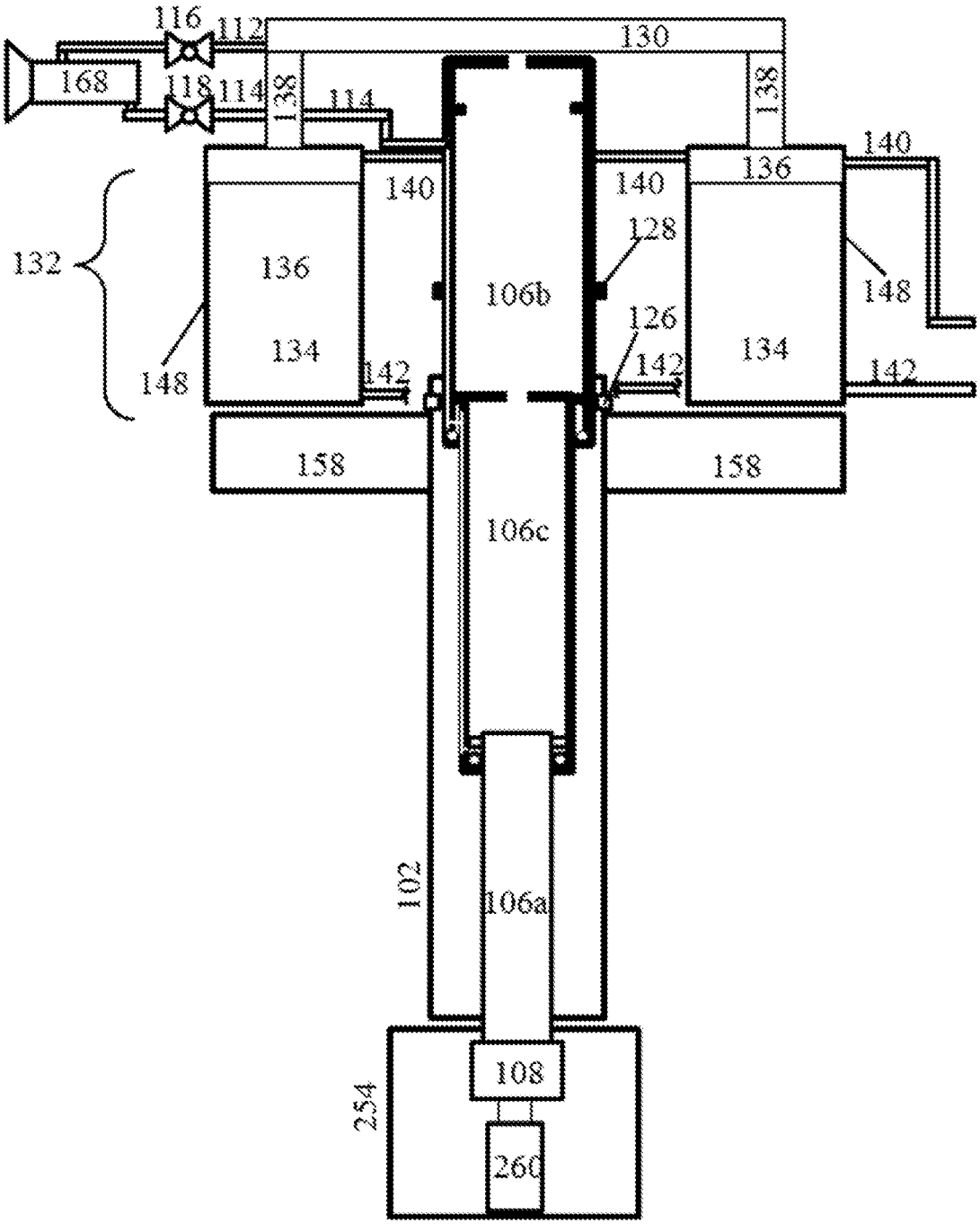

A hydraulic actuator 132 may retract the telescopic cylinder 104, as shown in FIG. 4*d*, through the following method. Fluid may be flowed from the over-retraction line 142 into the hydraulic cylinder 134. The volume of fluid flowed into the hydraulic cylinder 134 may be greater than the volume of the space below the piston 136 in the hydraulic cylinder 134, and the pressure of the fluid may be sufficient to actuate the piston 136. The fluid may push the piston 136 upwards. The force of this movement may be transferred to the telescopic cylinder 104 via the rod 138 and the link arm 130, such that the telescopic cylinder 104 is retracted. The outer cylinder 106*b* may be fully retracted, such that the outer cylinder 106*c* moves as far as allowed by the lower seal 126. While the telescopic cylinder 104 is retracted by the hydraulic actuators 132, the cylinders 106*a*-106*c* may be locked in position such that the cylinders 106*a*-106*c* may not differentially extend or retract.

Figure 4E:
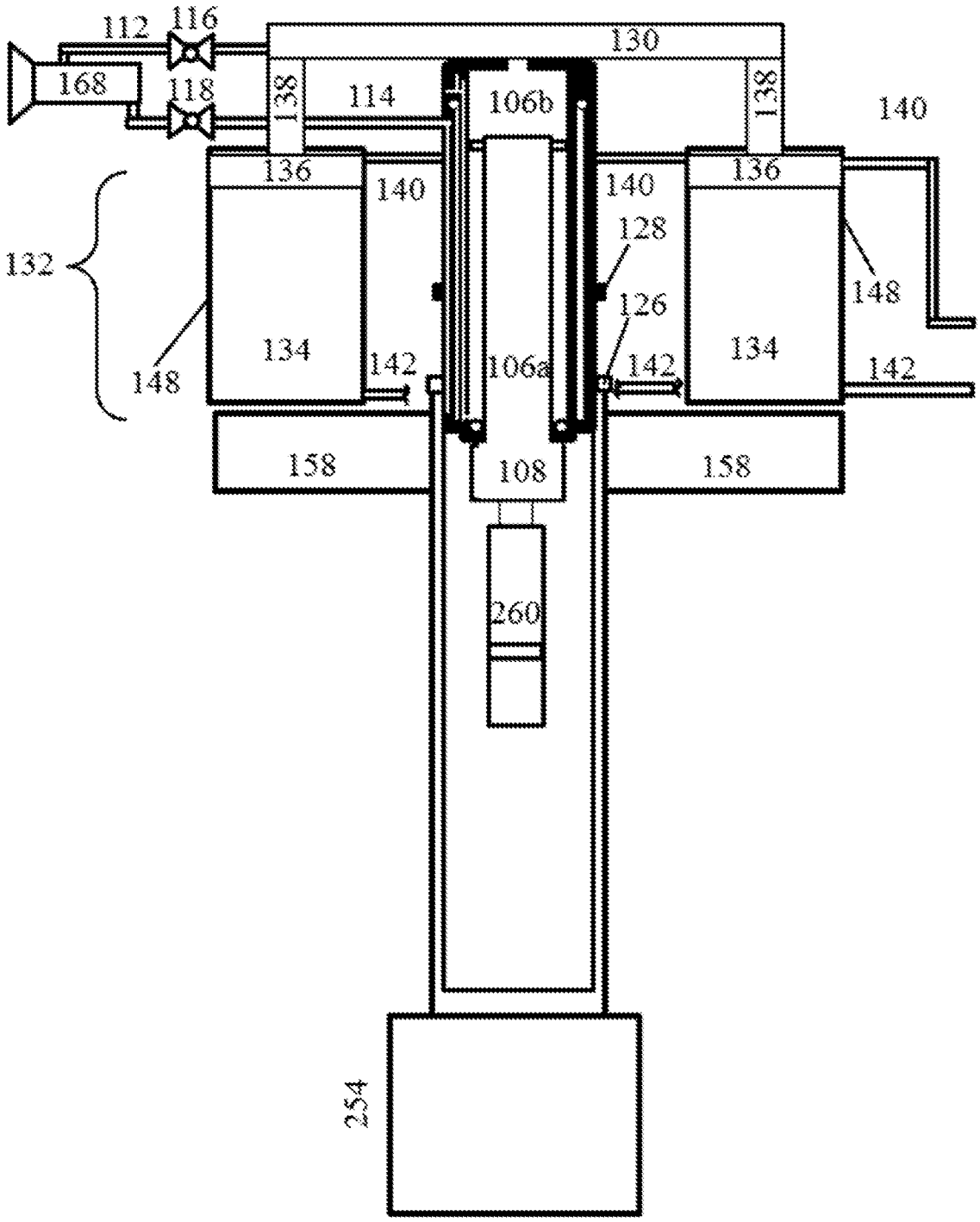

After the telescopic cylinder 104 has been retracted by the hydraulic actuators 132, the intermediate cylinder 106*c* and the inner cylinder 106*a* may be fully retracted, as shown in FIG. 4*e*, using the following method. The retraction valve 118 may be opened, allowing fluid from the retraction line 114 to flow into the telescopic cylinder 104. The volume of fluid flowed into the hydraulic cylinder 104 may be greater than the volume of the space between the cylinders 106*a*-106*c* below the barrier seals 110, and the pressure provided by the fluid may be sufficient to retract the inner cylinder 106*a* and/or the intermediate cylinder 106*c*. The fluid may push the inner cylinder 106*a* upward with respect to the intermediate cylinder 106*c*. The fluid may push the intermediate cylinder 106*c* upward with respect to the outer cylinder 106*a*. While the telescopic cylinder 104 is differentially retracted, the hydraulic actuators 132 may be locked in position.

The extendable wellbore tool 100 may then be removed from the Christmas tree 250. The extendable wellbore tool 100 may be disconnected using any means known in the art, and may be brought to a vessel using any means known in the art. The plugging element 260 may be removed from the extendable wellbore tool 100.

A method of installing a plugging element 260 in a subsea Christmas tree 250 will now be described, with reference to FIG. 3. A plugging element may be attached to the interface tool 108 of the extendable wellbore tool 100. The extendable wellbore tool 100 may be deployed to a subsea Christmas tree 250. The housing 102 of the extendable wellbore tool 100 may be fixedly attached to the Christmas tree 250 or to a piece of wellhead equipment 254 fixedly attached to the Christmas tree 250. The cylinders 106*a*-106*c* of the telescopic cylinder 104 may be differentially extended to position the telescopic cylinder 104 in a desired configuration. The desired configuration may be determined by the location at which it is desired to position the plugging element 260 within a bore 252 of the Christmas tree 250. The telescopic cylinder 104 may be extended as described above. The cylinders 106*a*-106*c* may be locked in the desired position.

Once the cylinders 106*a*-106*c* are locked in a desired configuration, the hydraulic actuators 132 may be used to extend the telescopic cylinder 104. The hydraulic actuators 132 may transfer sufficient force to the plugging element 260 through the telescopic cylinder 104 to engage the plugging element 260 with the Christmas tree 250.

A hydraulic actuator 132 may extend the telescopic cylinder 104 through the following method. Fluid may be flowed from the over-extension line 140 into the hydraulic cylinder 134. The volume of fluid flowed into the hydraulic cylinder 134 may be greater than the volume of the space above the piston 136 in the hydraulic cylinder 134, and the pressure provided by the fluid is sufficient to actuate the piston 136. The fluid may push the piston 136 downwards. The force of this movement may be transferred to the telescopic cylinder 104 via the rod 138 and the link arm 130, such that the telescopic cylinder 104 is extended.

In some embodiments, the hydraulic actuators 132 may not be used to extend the telescopic cylinder 104. In such embodiments, the differential extension of the cylinders 106*a*-106*c* may provide sufficient force to engage the plugging element 260 with the Christmas tree 250.

Once the plugging 260 element is engaged with the Christmas tree 250, the interface tool 108 may be disengaged from the plugging element 260 using any means known in the art. The cylinders 106*a*-106*c* of the telescopic cylinder 104 may be differentially retracted using the method described above. The extendable wellbore tool 100 may then be removed from the Christmas tree 250. The extendable wellbore tool 100 may be disconnected using any means known in the art, and may be brought to a vessel using any means known in the art.

In other embodiments of the method, the extendable wellbore tool 100 may be used to perform a wellbore operation other than installing or removing a plugging element 260. A tool or element may be attached to the interface tool 108. The telescopic cylinder 104 may be extended as described above, the tool may be used to perform a wellbore operation, and the telescopic cylinder 104 may be retracted.

The actuator, system, and method disclosed herein may have advantages over conventional actuators, systems, and methods for removing and installing plugging elements in subsea Christmas trees. The actuator may have a smaller profile than conventional actuators capable of providing the same amount of force. The smaller profile may make the actuator easier to install and use on a wellhead and may allow the actuator to be used with other subsea equipment having a smaller diameter. In some cases, it may eliminate the need to use equipment which is connected to a vessel. The actuator may also be able to remove or install plugging elements which similarly sized conventional actuators would not be able to install, because the actuator is capable of providing a greater pulling force and a greater pushing force than similarly sized conventional actuators. Being able to pull or install plugs without additional equipment may prevent downtime at a wellhead site.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed is:

1. An extendable wellbore tool comprising:

a housing;

a telescopic cylinder disposed within the housing, the telescopic cylinder comprising two or more cylinders configured to extend and retract relative to each other; and one or more hydraulic actuators configured to extend and retract the telescopic cylinder relative to the housing; and a link arm connecting the one or more hydraulic actuators to the telescopic cylinder, wherein an end of an innermost cylinder of the two or more cylinders is attached to an interface tool configured to engage a plugging element for removing or installing within a Christmas tree.

2. The extendable wellbore tool of claim 1, wherein the one or more hydraulic actuators are configured to be extended and retracted via one or more hot stabs.

3. The extendable wellbore tool of claim 1, wherein the two or more cylinders of the telescopic cylinder are configured to be extended and retracted relative to each other via hydraulic actuation.

4. The extendable wellbore tool of claim 1, wherein the telescopic cylinder is coupled to the housing such that the telescopic cylinder is extended and retracted through the housing.

5. The extendable wellbore tool of claim 1, wherein the one or more hydraulic actuators are fixedly attached to the housing via an actuator body.

6. The extendable wellbore tool of claim 1, wherein the one or more hydraulic actuators comprises an annular hydraulic actuator, concentric with the housing.

7. The extendable wellbore tool of claim 1, wherein the two or more cylinders comprise an outer cylinder, one or more intermediate cylinder disposed within the outer cylinder, and an inner cylinder disposed within the intermediate cylinder.

8. The extendable wellbore tool of claim 7, wherein the telescopic cylinder further comprises:

barrier seals disposed between adjacent cylinders;

an upper passageway and a retraction passageway formed in the outer cylinder, configured to allow fluid to flow therethrough; and an upper passageway and a retraction passageway formed in the intermediate cylinder, configured to allow fluid to flow therethrough.

9. The extendable wellbore tool of claim 8, further comprising valves disposed in the upper passageways and the retraction passageways.

10. The extendable wellbore tool of claim 7, wherein the outer cylinder is configured to extend and retract through the housing.

11. The extendable wellbore tool of claim 10, further comprising a shoulder disposed on an outer surface of the outer cylinder configured to function as a hard stop between the outer cylinder and the housing.

12. A method comprising:

extending an extendable wellbore tool, the extendable wellbore tool being attached to a Christmas tree;

performing a wellbore operation; and retracting the extendable wellbore tool, wherein the extendable wellbore tool comprises:

a housing;

a telescopic cylinder disposed within the housing, the telescopic cylinder comprising two or more cylinders configured to extend and retract relative to each other;

one or more hydraulic actuators, configured to extend and retract the telescopic cylinder; and a link arm connecting the one or more hydraulic actuators to the telescopic cylinder, wherein the wellbore operation comprises removing a plugging element from the Christmas tree, wherein removing the plugging element comprises:

extending the cylinders of the telescopic cylinder relative to each other;

engaging an interface tool attached to an end of the telescopic cylinder with the plugging element;

disengaging the plugging element from the Christmas tree; and retracting the cylinders of the telescopic cylinder relative to each other.

13. The method of claim 12, wherein disengaging the plugging element from the Christmas tree comprises retracting the telescopic cylinder using the one or more hydraulic actuators.

14. The method of claim 13, the method further comprising locking the cylinders of the telescopic cylinder during the disengaging.

15. The method of claim 12, wherein the wellbore operation comprises installing a second plugging element in the Christmas tree, the method further comprising:

engaging the second plugging element with the interface tool attached to the end of the telescopic cylinder;

extending the cylinders of the telescopic cylinder relative to each other;

engaging the second plugging element with the Christmas tree;

retracting the cylinders of the telescopic cylinder relative to each other.

16. The method of claim 15, wherein engaging the second plugging element with the Christmas tree comprises extending the telescopic cylinder using the one or more hydraulic actuators.

17. The method of claim 16, the method further comprising locking the cylinders of the telescopic cylinder during the engaging.

18. A method comprising:

extending an extendable wellbore tool, the extendable wellbore tool being attached to a Christmas tree;

performing a wellbore operation; and retracting the extendable wellbore tool, wherein the extendable wellbore tool comprises:

a housing;

a telescopic cylinder disposed within the housing, the telescopic cylinder comprising two or more cylinders configured to extend and retract relative to each other;

one or more hydraulic actuators configured to extend and retract the telescopic cylinder; and a link arm connecting the one or more hydraulic actuators to the telescopic cylinder, wherein the wellbore operation comprises installing a plugging element from the Christmas tree, wherein installing the plugging element comprises:

engaging the plugging element with an interface tool attached to an end of the telescopic cylinder;

extending the cylinders of the telescopic cylinder relative to each other;

engaging the plugging element with the Christmas tree; and retracting the cylinders of the telescopic cylinder relative to each other.

19. The method of claim 18, wherein engaging the plugging element with the Christmas tree comprises extending the telescopic cylinder using the one or more hydraulic actuators.

20. The method of claim 19, the method further comprising locking the cylinders of the telescopic cylinder during the engaging.

21. The method of claim 18, wherein the wellbore operation comprises removing the plugging element from the Christmas tree, the method further comprising:

extending the cylinders of the telescopic cylinder relative to each other;

engaging the interface tool attached to the end of the telescopic cylinder with the plugging element;

disengaging the plugging element from the Christmas tree;

retracting the cylinders of the telescopic cylinder relative to each other.

22. The method of claim 21, wherein disengaging the plugging element from the Christmas tree comprises retracting the telescopic cylinder using the one or more hydraulic actuators.

23. The method of claim 22, the method further comprising locking the cylinders of the telescopic cylinder during the disengaging.

* * * * *